United States Patent [19]

Fujie et al.

[11] 4,060,125

[45] Nov. 29, 1977

[54] HEAT TRANSFER WALL FOR BOILING LIQUIDS

[75] Inventors: Kunio Fujie, Tokyo; Wataru Nakayama; Heikichi Kuwahara, both of Kashiwa; Kimio Kakizaki, Hitachi, all of Japan

[73] Assignees: Hitachi Cable, Ltd.; Hitachi, Ltd., both of Japan

[21] Appl. No.: 586,930

[22] Filed: June 16, 1975

[30] Foreign Application Priority Data

Oct. 21, 1974 Japan ..... 49-120261

[51] Int. Cl.[2] ..... F28F 13/00

[52] U.S. Cl. ..... 165/133; 29/157.3 R

[58] Field of Search ..... 165/133; 29/157.3, DIG. 23

[56] References Cited

U.S. PATENT DOCUMENTS

| | | | |
|---|---|---|---|
| 3,454,081 | 7/1969 | Kun et al. | 165/133 |
| 3,457,990 | 7/1969 | Theophilos et al. | 165/133 |
| 3,496,752 | 2/1970 | Kun et al. | 165/133 |
| 3,566,514 | 3/1971 | Szumigala | 165/133 X |
| 3,684,007 | 8/1972 | Ragi | 165/133 |
| 3,696,861 | 10/1972 | Webb | 165/133 |
| 3,753,364 | 8/1973 | Runyan | 165/133 X |
| 3,768,291 | 10/1973 | Rieger | 165/133 UX |

*Primary Examiner*—Ronald H. Lazarus
*Assistant Examiner*—Ira S. Lazarus
*Attorney, Agent, or Firm*—Craig & Antonelli

[57] ABSTRACT

A heat transfer wall for boiling liquids having a multiplicity of minute tunnels parallelly extending and spaced a distance of not more than 1 mm under the metal wall surface in contact with liquid. Each tunnel is communicated with the outside by a multiplicity of tiny holes formed at regular intervals of not more than 1 mm along the tunnel. The wall surface portion is in one piece with the wall body. The holes combinedly account for from 2 to 50% of the total surface area of the wall. The regularly formed holes are substantially triangular shaped. The wall is made of either copper or aluminum.

16 Claims, 4 Drawing Figures

HEAT TRANSFER WALL FOR BOILING LIQUIDS

This invention relates to a heat transfer wall capable of transferring heat to liquids with improved efficiency.

For effective transfer of heat from a surface of heat transfer wall of thermally conducted metals such as copper, aluminum or the like, for example, from a surface of a plate or a other metal plate or pipe to a liquid in contact therewith, e.g., a liquid of a relatively low boiling point, such as Freon, nitrogen, or oxygen in liquefied state or alcohol, it has been proposed to roughen the heat transfer surface by sintering metal powder and forming a porous layer thereon. The wall having such a porous surface or numerous active boiling spots on the surface is known to exhibit better heat transfer characteristic than that of a conventional wall simply provided with fins or the like for an extended surface area. However, the proposed heat transfer wall has a drawback in that some impurity, e.g., oil, which may be present in the liquid being handled can clog the minute, intricately intercommunicated cells of the porous layer, resulting in a decrease of the heat transfer rate.

The present invention is directed to the provision of a heat exchange wall that does not have the foregoing drawback but is capable of efficiently carrying out heat transfer for a longer period of time than has hitherto been possible.

According to the invention, a multiplicity of minute tunnels are formed substantially in parallel immediately under the surface of the metal wall that contacts liquid, and the tunnels are communicated with the outside through tiny holes formed at regular intervals along the individual tunnels.

The term "minute tunnels" as used herein means fine subsurface hollows, each measuring approximately from 0.1 to 0.8 mm in width and from 0.2 to 0.8 mm in depth, spaced apart from 0.2 to 1.0 mm from adjacent ones. These tunnels are formed by grooving the wall surface and then closing the open tops of the grooves. The tiny holes for establishing communication between the tunnels and the outside are formed by previously forming holes or notches regularly in members or parts that close the open tops of the grooves at intervals of not more than about 1 mm. Alternatively, they may be formed afterwards.

With a heat exchange wall having such tunnels and holes, bubbles of vapor produced on boiling of the liquid inside a tunnel between a pair of tiny adjacent holes formed along the tunnel will partly leave the tunnel through one of the holes, while the liquid will flow into the tunnel through the other hole. Thus, a definite flow of bubbles and liquid is established between any pair of holes. While the flow is maintained between the adjacent tiny holes, some of the bubbles left behind near the tiny holes will repeat growth and partial detachment from the wall. This omits the step of bubble formation from the usual cycle of bubbling that consists of bubble formation, growth, and release, thus shortening the waiting period for bubble release. Consequently, the quantity of heat transferred will be large even where the temperature difference between the wall surface and the liquid is small, and the heat transfer characteristic is accordingly improved.

Our experiment has indicated that, even with the novel and effective heat transfer wall just described, an increase in the quantity of vapor retained in the tunnels will adversely affect the heat transfer characteristic because the vapor provides a heat resistance due to the difference between the heat transfer rates of the liquid and vapor. For this reason the quantity of vapor bubbles retained in the tunnels must be limited. It is thus an object of the present invention to provide a heat transfer wall capable of maintaining effective heat transfer characteristic. The object can be realized by confining the percentage of the combined hole area in the overall surface area of the wall, which is known in the art as the "opening ratio", within the range from 2 to 50%. To attain the end, it is only necessary to adjust the size of tiny holes when the number of holes to be formed is constant or to adjust the number when the hole size is constant.

The above and other objects and advantages of the present invention will become more apparent from the following description taken in conjuction with the accompanying drawings, wherein.

Figure 1:
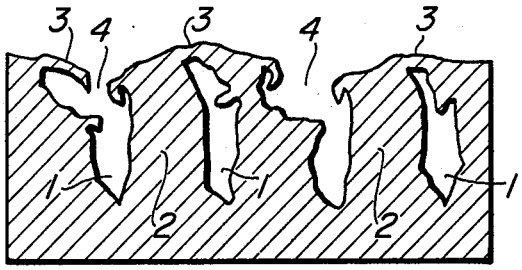
FIG. 1 is an enlarged sectional view of a copper pipe surface layer embodying the invention.
Figure 2:
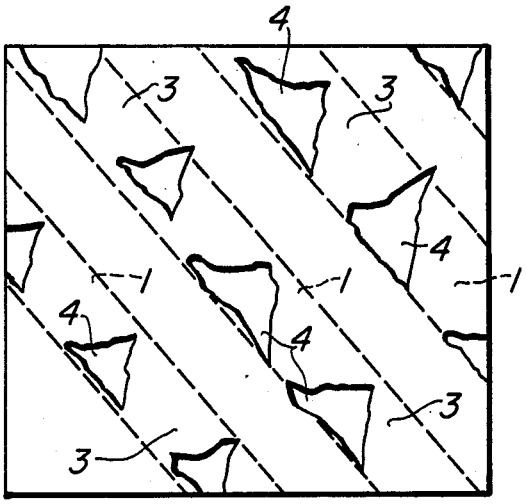
FIG. 2 is an enlarged plan view of the same surface.

Referring to FIG. 1, substantially parallel minute tunnels 1 extend helically, spaced apart by fine walls 2 and bridged at intervals thereover by thin walls 3. The walls 2 and 3 are formed in one piece with the pipe body. Each opening where the wall 3 is torn open represents a tiny hole 4 for communicating the tunnel with the outside. As shown in FIG. 2, the holes 4 are of a given size and are located at regular intervals along the tunnels 1. A copper pipe having such a surface can be obtained by sequentially knurling, cutting, and wire brushing the pipe. The size of the holes 4 can be adjusted by controlling the dimensions of the shallow grooves to be formed by knurling and the pressure with which the brushes are held in contact with the work during wire brushing.

For the knurling, a knurling tool carrying a roll formed with a plurality of continuous helical cutting ribs is attached to the tool rest of a lathe and is forced into contact with the surface of a copper pipe securely chucked and rotating on the machine, and then moving the tool rest along the guide screw.

The copper pipe shown in section was knurled with a knurling tool of R-50 (for grooving at a pitch of 50 grooves per inch to a depth of 0.15 mm). The machining produced continuous helical grooves, V-shaped in cross section and 0.15 mm deep, parallelly at the given pitch on the copper pipe. For the purpose of the invention, the shallow grooves may be formed by turning with a cutting tool instead of by rolling as in knurling.

The next step of cutting is performed by machining the copper pipe in such a manner as to scrape and deform the surface across the shallow grooves without cutting away the surface layer. Several cutting tools are set on the tool rest and are forced against the copper pipe surface generally in the same way as in forming a multiple start screw.

In the embodiment shown, the pipe surface was machined substantially at right angles to the grooves formed by knurling, to a depth of 0.4 mm at a pitch of 0.4 mm. As a result, the pipe surface had helically continuous grooves 0.76 mm in depth and arranged closely in parallel, and 0.2 mm-thick ribs formed with minute V-shaped recesses regularly on the upper edges and separating the grooves. The regularly formed recesses are remnants of the shallow V-shaped grooves created by knurling. They eventually will constitute tiny holes 4. Similarly, the minute ribs will become walls 2, 3, and the deep grooves tunnels 1.

Wire brushing is conducted as the machined copper pipe is passed through a brusher which consists of a plurality of wire brush wheels arranged along the path of the pipe. Each brush wheel is movable toward and away from the axis of the path, and its own axis is substantially parallel to the grooves formed on the pipe surface. The brush wheels are adjustable in position so that the periphery of each wheel is in contact with a given circle. Then the machined copper pipe is introduced into the path for brushing. The minute ribs on the pipe surface will not entirely be forced down but only their upper edges between the recesses will be vigorously rubbed by the wire brush wheels. They are softened by the brush pressure and heat generated by the friction and are stretched into thin films circumferentially of the pipe surface, until they are pressed integrally against intermediate points of the adjacent ribs.

In the manner described, the grooves between the ribs are closed by thin walls 3 to form tunnels. Since the thin walls have tiny holes 4 of a substantially triangular shape formed at regular intervals by the remnants of the V-shaped recesses and the intermediate parts of the adjacent ribs, the tunnels 1 are communicated at corresponding intervals with the outside through the holes 4.

Figure 3:
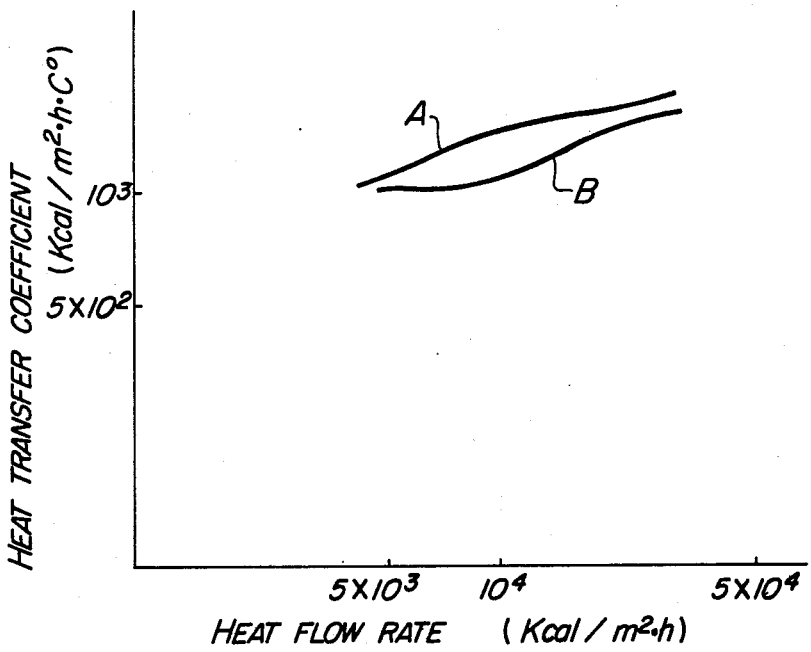
FIG. 3 is a graph comparing the characteristic curves of a copper pipe formed with a porous surface layer and a copper pipe of the invention.

The characteristic of the heat transfer pipe thus obtained was compared with that of the prior art pipe provided with a porous layer. The results, summarized in FIG. 3, clearly indicate that the pipe embodying the invention, represented by the curve A, is superior in performance to the conventional pipe represented by the curve B. In the embodiment under consideration, the size of the holes 4 was adjusted by varying the pressure with which the wire brush wheels were held in contact with the pipe surface.

Figure 4:
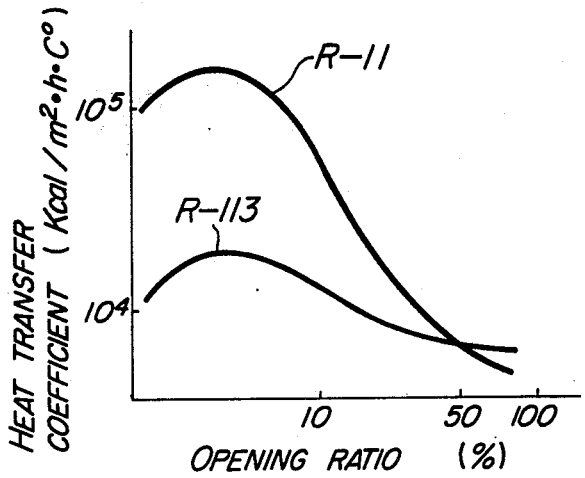
FIG. 4 is a graph showing the relationship between the opening ratio and heat transfer characteristic.

A number of pipes each of which has tunnels and holes having a different opening ratio are prepared by the similar manner as described, and the heat transfer characteristic of the pipes was examined using test liquids of trichloromonofluoromethane (R-11) and trichloroethane (R-113). The results are graphically illustrated in FIG. 4. It will be seen from the graph that the heat transfer coefficient of the pipe is high with an opening ratio between 2 and 10% when R-11 is handled and between 2 and 50% when R-113 is handled.

What is claimed is:

1. A heat transfer wall of thermally conductive metal for contacting a liquid and transferring heat to said liquid, comprising:

a multiplicity of tunnels formed beneath a surface of said heat transfer wall to be in contact with said liquid and separated from said surface by a thin surface layer of the metal of said heat transfer wall, each of said tunnels being parallel to and spaced from an adjacent tunnel through a thin wall of the metal of said heat transfer wall, the spacing between adjacent two tunnels being in the range between 0.2 and 1.0 millimeter, each tunnel having a width in the range between 0.1 and 0.8 millimeter and each tunnel having a depth in the range between 0.2 and 0.8 millimeter; and a multiplicity of tiny holes formed through said thin surface layer separating each of said tunnels from the surface of said heat transfer wall to be in contact with said liquid, for providing communication between the interiors of said tunnels and the surface of said heat transfer wall to be in contact with said liquid, said tiny holes being arranged equidistantly along each of said tunnels at intervals of less than 1 millimeter and being of a substantially equilateral triangular-shape.

2. A heat transfer wall according to claim 1 wherein said thin surface layer is made integrally with the thin walls located between the tunnels in the heat transfer wall.

3. A heat transfer wall according to claim 2 wherein said wall is made of copper.

4. A heat transfer wall according to claim 2 wherein said wall is made of aluminum.

5. A heat transfer wall according to claim 1 wherein the open area of the holes together account for from 2 to 50% of the total area of said surface.

6. A heat transfer wall according to claim 2 wherein the open area of the holes together account for from 2 to 50% of the total area of said surface.

7. A heat transfer wall according to claim 6 wherein said wall is that of a pipe and said tunnels extend helically.

8. A heat transfer wall according to claim 7 wherein said wall is made of copper.

9. A heat transfer wall according to claim 7 wherein said wall is made of aluminum.

10. A heat transfer wall according to claim 1 wherein said wall is that of a pipe and said tunnels extend helically.

11. A heat transfer wall according to claim 1 wherein the wall is made of copper.

12. A heat transfer wall according to claim 1 wherein said wall is made of aluminum.

13. A heat transfer wall according to claim 2 wherein said wall is that of a pipe and said tunnels extend helically.

14. A heat transfer wall according to claim 13 wherein said wall is made of copper.

15. A heat transfer wall according to claim 13 wherein said wall is made of aluminum.

16. A heat transfer wall according to claim 1 wherein said holes are arranged in rows with the holes in adjacent rows being offset from each other.

* * * * *